US006854748B2

(12) United States Patent
Wimbish et al.

(10) Patent No.: US 6,854,748 B2
(45) Date of Patent: Feb. 15, 2005

(54) SKATEBOARD

(75) Inventors: James F. Wimbish, Mesa, AZ (US); Howard A. Lindsay, Scottsdale, AZ (US); Kevin Tisue, Salt Lake City, UT (US)

(73) Assignee: James F. and Lori Wimbush Trust, Imlay City, MI (US)

( * ) Notice: Subject to any disclaimer, the term of this patent is extended or adjusted under 35 U.S.C. 154(b) by 61 days.

(21) Appl. No.: 10/313,436

(22) Filed: Dec. 6, 2002

(65) Prior Publication Data

US 2003/0127831 A1 Jul. 10, 2003

Related U.S. Application Data

(60) Provisional application No. 60/340,472, filed on Dec. 7, 2001.

(51) Int. Cl.[7] ..... A63C 5/04; A63C 5/00

(52) U.S. Cl. ..... 280/87.042; 280/14.21; 280/608

(58) Field of Search ..... 280/87.01, 87.03, 280/87.041, 87.042, 12.1, 14.21, 14.22, 11.12, 600, 601, 602, 608, 609, 610, 87.021

(56) References Cited

U.S. PATENT DOCUMENTS

| | | | | |
|---|---|---|---|---|
| 4,155,565 A | | 5/1979 | de Caussin et al. | |
| 4,184,693 A | | 1/1980 | Whitmarsh | |
| 4,337,963 A | | 7/1982 | Stevenson | |
| 4,731,038 A | | 3/1988 | Hancock et al. | |
| 4,897,063 A | | 1/1990 | Scheurer et al. | |
| 4,995,631 A | * | 2/1991 | Hunter | 280/607 |
| 5,299,822 A | * | 4/1994 | Mayr et al. | 280/610 |
| 5,312,258 A | | 5/1994 | Giorgio | |
| 5,474,314 A | * | 12/1995 | Lehman | 280/87.042 |
| 5,573,264 A | | 11/1996 | Deville et al. | |
| 5,590,908 A | * | 1/1997 | Carr | 280/809 |
| 5,707,068 A | | 1/1998 | Bradfield | |
| 6,203,037 B1 | | 3/2001 | Wilson et al. | |
| 6,273,440 B1 | | 8/2001 | Wilson | |
| 6,293,571 B1 | | 9/2001 | Wen | |
| 6,431,733 B2 | * | 8/2002 | Seifert et al. | 362/459 |
| 6,502,850 B1 | * | 1/2003 | Schaller et al. | 280/610 |
| 6,527,284 B2 | * | 3/2003 | Bert | 280/87.041 |
| 6,659,492 B2 | * | 12/2003 | Gousie | 280/604 |
| 2002/0070515 A1 | | 6/2002 | Barbieri et al. | |

* cited by examiner

*Primary Examiner*—Christopher P. Ellis
*Assistant Examiner*—Brian L Swenson
(74) *Attorney, Agent, or Firm*—Snell & Wilmer LLP

(57) ABSTRACT

The present invention provides improved boards and board materials for use in various sports and leisure context. In particular embodiments of the present invention, the boards are well suited for use in skateboards. The board may be provided with varying numbers of layers of material as well as include various edges and protective guards that are placed on the board. Additionally, the protective edges and guards are integrated in novel techniques, which prevent such guards falling off the board during use. Additionally, the board used in a deck assembly of a skateboard (or other board) is comprised of a novel construction of a lightweight yet rigid material in combination with an even lighter material. Different materials may be substituted in and out of the board in order to adjust the physical characteristics of the board.

6 Claims, 3 Drawing Sheets

SKATEBOARD

CROSS REFERENCE TO RELATED APPLICATION

This application claims the benefit of the filing date of U.S. Provisional Patent Application Serial No. 60/340,472, filed Dec. 7, 2001.

FIELD OF THE INVENTION

The present invention relates to an improved design for sports and leisure related boards and board materials, particularly suited to skateboards.

BACKGROUND OF THE INVENTION

Various boards and board materials are used in a variety of sports and leisure contexts. For example, various "boards" exist in the fields of, among others, snowboards and snow skis, water skis, and particularly skateboards.

Additionally, there are a vast number of materials used in these various boards. For example, prior art skateboard materials typically consist of a laminated wood deck to which an axle and wheel assembly (a "truck") is attached at antipodal ends. However, due the nature of their use, such as the execution of what are commonly known as "tricks" (various flips, turns, jumps and twists), the deck of the skateboard takes a great deal of abuse, typically in the form of stress, strain, and torsion. Similar forces can be found in other sports such as snowboarding, skiing and water skiing.

The same abuse often results in the deterioration of wood decks at an accelerated rate. Moreover, not only do the various stresses placed on the boards wear the decks out, but various sliding and gliding into pavement and other rigid objects tend to wear out the boards, typically causing the separation and delamination of wood decks as well as chips, scratches and fractures.

Attempts to overcome some of the problems with wood laminate decks have included the use of various polymeric, plastic, fiberglass and metal materials. Such materials address some of the concerns found with laminate wood decks in that separation is less likely and they often have an increased resistance to wear. However, because of the increased cost of such materials, the boards themselves become increasingly expensive.

Various measures have also been taken to protect assorted surfaces of the boards including the addition of various protective edges and skid plates which are attached to the boards. For example, plastic edges when encircle the perimeter of the board and skid plates attached to protect surfaces of the board which may be prone to wear. However, these measures are generally added after the manufacture of the board and suffer from various deficiencies including separating from the board.

Still further, an important attribute to a board such as a skateboard, is the "feel" of the board to the user. For example, many users prefer the "feel" associated with the weight of a laminate wood deck. However, existing materials which have been substituted for with laminate, tend to have a weight which is different than laminate wood, thus giving the board an overall different "feel". Likewise, the materials substituted for laminate wood also generally have much different stiffnesses than the wood laminate. Again, this difference in physical characteristic contributes to a different feel to the user.

Further still, with all materials known heretofore, there exists little ability to change the weight and/or feel of the board once it has been manufactured. Stated otherwise, the stiffness, weight and other physical attributes remain the same throughout the life of the board itself.

Thus, existing boards do not adequately address the aforementioned stresses involved with typical, intended use. Moreover, the physical characteristics, such as stiffness, of the boards are generally inflexible. Likewise, prior art boards deteriorate with use and exposure to the elements at a rapid rate. Accordingly, improved boards and board materials which address these and other disadvantages are desirable.

SUMMARY OF THE INVENTION

While the way that the present invention addresses the disadvantages of the prior art is discussed in greater detail below, in general, the present invention provides improved boards and board materials for use in various sports and leisure contexts, and in particular embodiments of the present invention, the boards are well suited for use in skateboards.

For example, in accordance with various aspects of the present invention, the board may be provided with varying numbers of layers of material as well as include various edges and protective guards are placed on the board. Additionally, the protective edges and guards are integrated with the board in novel techniques which prevent such guards from falling off of the board during use.

Additionally, in accordance with other aspects of the present invention, the board used in a deck assembly of a skateboard (or other board) is comprised of a novel construction of a lightweight, yet rigid material in combination with an even lighter material. In accordance with the various embodiments of the present invention, different materials may be substituted in and out of the board in order to adjust the physical characteristics of the board.

BRIEF DESCRIPTION OF THE DRAWINGS

A more complete understanding of the present invention may be derived by referring to the detailed description when considered in connection with the Figures, where like reference numbers refer to similar elements throughout the Figures, and.

DETAILED DESCRIPTION

The following description is of exemplary embodiments of the invention only, and is not intended to limit the scope, applicability or configuration of the invention in any way. Rather, the following description is intended to provide a convenient illustration for implementing various embodiments of the invention. As will become apparent, various changes may be made in the function and arrangement of the elements described in these embodiments without departing from the scope of the invention as set forth herein. For example, in the context of the present invention, the method and apparatus hereof find particular use in connection with skateboards, though, generally speaking, the present invention may be equally applicable to various other applications, such as, for example, snowboards, snow skis, water skis or the like. Likewise, though various portions of the specification refer to particular materials, various other materials, now known or as yet unknown, having properties similar to those discussed herein should be considered within the scope of the present invention.

That being said, in accordance with various aspects of the present invention and with reference to the various embodiments of FIGS. 1–4, an exemplary board (here, in the context of a skateboard) in accordance with the present invention is illustrated. As will be appreciated, skateboard 100 exhibits improved properties over existing board materials as well as improved means of manufacturing the same. For example, the configuration of various board materials in accordance with the description herein, provides the ability to adjust physical attributes of the board as well as offering increased protection of the board materials themselves.

Figure 1:
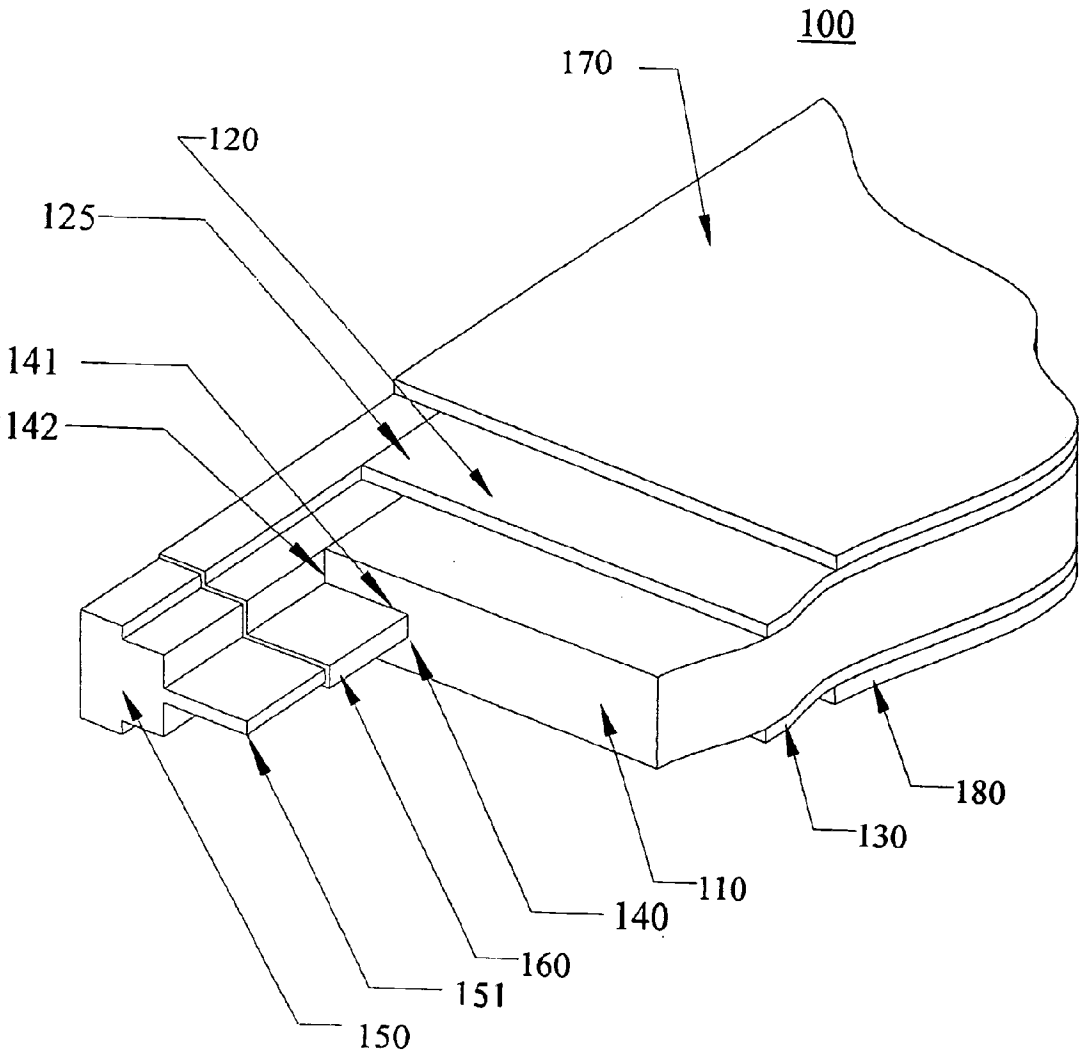
FIG. 1 is a cross-sectional, perspective view of a board in accordance with the present invention.

With particular reference now to FIG. 1, an exemplary embodiment of a board 100 in accordance with the present invention is illustrated. In this exemplary embodiment, board 100 exhibits improved properties such as strength, stiffness, ease of manufacturing and resistance to wear and deterioration. For example, board 100 of FIG. 1 comprises a core material 110 having an upper reinforcement 120 and a lower reinforcement 130 which are suitably applied to opposing sides of core 110. Core 110 is preferably manufactured in the generally desired shape of board 100. For example, in the present embodiment, in the shape of skateboard (e.g., having a rectilinear shape, with or without "kick plates" for foot placement). In this regard, core 110 may be molded, cut, forged, cast or otherwise created depending on the material core 110 comprises.

In the present embodiment, core 110 comprises wood or a wood laminate, though it should be appreciated that various other materials may be substituted in accordance with the present invention, depending on the properties desired in board 100. For example, other exemplary materials include various plastics, nylons, metals and other similar materials. Additionally, as will be described in further detail below, core 110 may be suitably configured with an edge attachment mechanism 140 which assists in retaining a guard 150, which increases various properties of the board including physical characteristics and aesthetics.

As mentioned above, in its various embodiments, board 100 comprises upper and lower reinforcements 120, 130 and are suitably bonded to core 110 (e.g., using an adhesive, screw, staple or other equivalent affixing mechanism). Upper and lower reinforcements 120, 130 preferably have substantially the same profile as core 110, and in various exemplary embodiments, have overlapping edges 125 which, as will be appreciated below, assist in strengthening and securing the components of board 100. In the presently described embodiment, upper and lower reinforcements 120, 130 preferably comprise a fibrous laminate and/or various composite materials such as Kevlar™, graphite or fiber glass, though as with core 110, it will appreciated that various other materials such as various plastics, nylons, metals and other similar materials, may likewise be substituted depending on the desired properties and still fall within the ambit of the appended claims. However, benefits associated with fibrous laminates provide the ability to adjust physical properties, particularly flexural properties based on the angles of the fiber orientations. Similarly, the same may provide the ability for board 100 to have non-homogeneous properties across its area. For example, by varying fiber orientations, board 100 may be stiffer at its center, yet less stiff at its ends.

Now, with continuing reference to FIG. 1, as mentioned above, various embodiments of board 100 may include various components such as guard 150. For example, in the presently described embodiment, guard 150 comprises a circumferential edge surrounding the perimeter of board 100. Guard may comprise any number of materials, including various plastics, nylons, metals and other similar materials. In the present embodiment, guard 150 comprises aluminum. Guard 150 may be molded, cut, forged, cast or otherwise created depending on its particular application. In this context, guard 150 thus suitably provides protection to board 100, particularly around it edges. Likewise, as above, guard 150 may alternatively be comprised of various plastics, nylons, metals and other similar materials.

As also mentioned above guard 150 is affixed to board 100 through attachment mechanism 140. For example, in this embodiment, attachment mechanism 140 comprises a groove 141 in an outer perimeter 142 of core 110 which is configured to receive a tongue 151 configured on guard 150. Thus, tongue 151 may be inserted into groove 141 in manner which integrates guard 150 with core 110, and thereby, board 100. In its various embodiments, tongue 151 and groove 141 may be secured by various manners including via an adhesive bond 160 such as a glue. However, various other means may secure tongue 151 and groove 141 such as a "press" or "snap" fit, as well as various screws, nails, staples and other equivalents. Additionally, it should be appreciated that in various alternative embodiments, attachment mechanism 140 may take other alternative configurations. For example, multiple tongues and grooves may be provided, respective orientations may be changed (e.g., groove on edge, tongue on core) and various other interlocking and attachments may be used. in any event, it should be appreciated that a number of means of attaching guard 150 to board 100 fall within the scope of the present invention.

Additionally, various other aspects of board 100 may assist in securing the components of board 100, including overlapping edges 125 of upper and lower reinforcement 120, 130 mentioned above. For example, once tongue 151 is inserted into groove 141, overlapping edges 125 suitably extended beyond outer perimeter 142 and attach to guard 150, thereby further securing guard 150. Again, as above, various attachment mechanisms may used in conjunction with the present invention, and in the present instance, an adhesive glue is preferable.

In accordance with further aspects of the present invention, board may further comprise an upper protective layer 170 and a lower protective layer 180. In such embodiments, upper and lower protective layers 170, 180 suitably protect the internal components of board 100 and/or improve various aesthetics and or the functionality of board 100. For example, layers 170, 180 may comprise a non-skid surface applied to board 100 so that users have increased traction. Additionally (or alternatively), layers 170, 180 may have various designs and colors which improve the aesthetics of board. For example, layers 170, 180 may incorporate various colors, graphics, engravings, embossing or the like. Further still, properties of layers 170, 180 may improve the physical properties of board 100. For example, layers 170, 180 may be comprised of plastic tape, thus providing strength and resiliency against scratches, wear, fracture or the like.

Accordingly, boards 100 in accordance with various aspects of the present invention realize significant improvements over the prior art.

Further still, boards in accordance with the present invention may also exhibit additional aspects.

Figure 2:
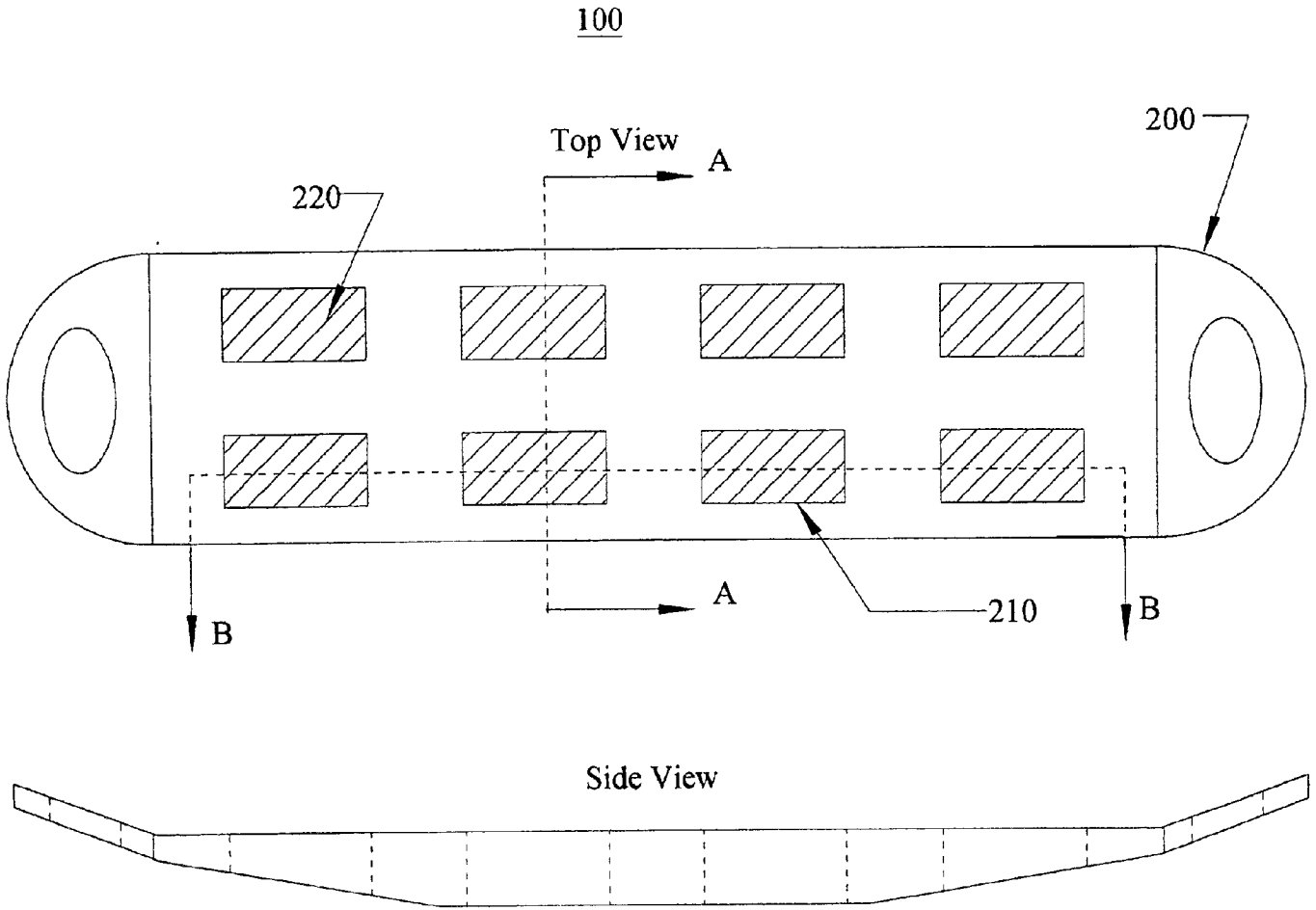
FIG. 2 is a perspective view of an exemplary skateboard in accordance with the present invention.
Figure 3:
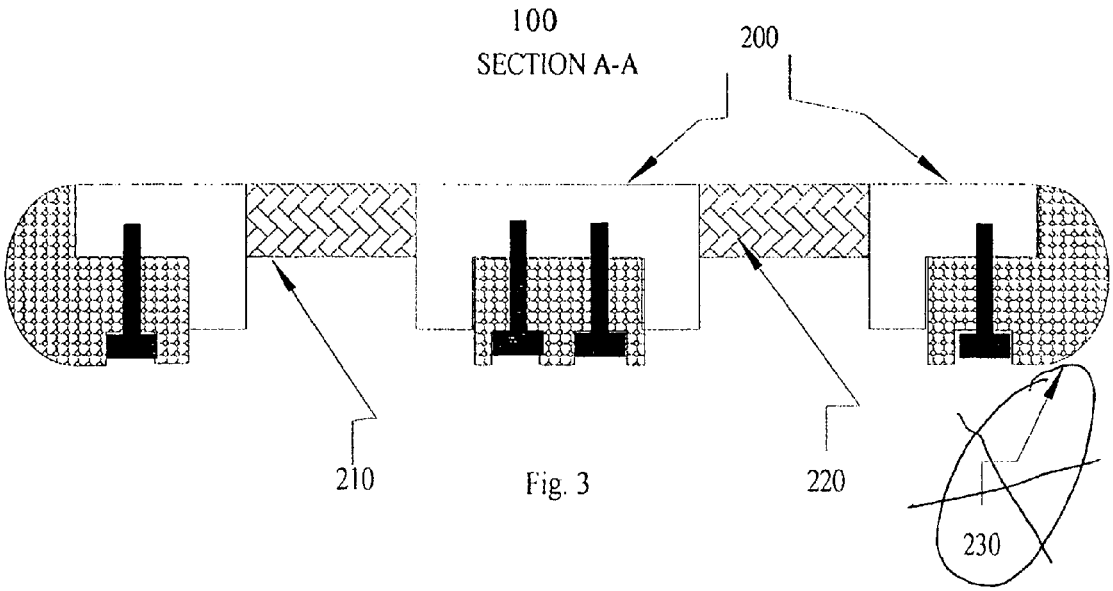
FIG. 3 is a cross-sectional view of the skateboard of FIG. 1 along section line A—A.
Figure 4:
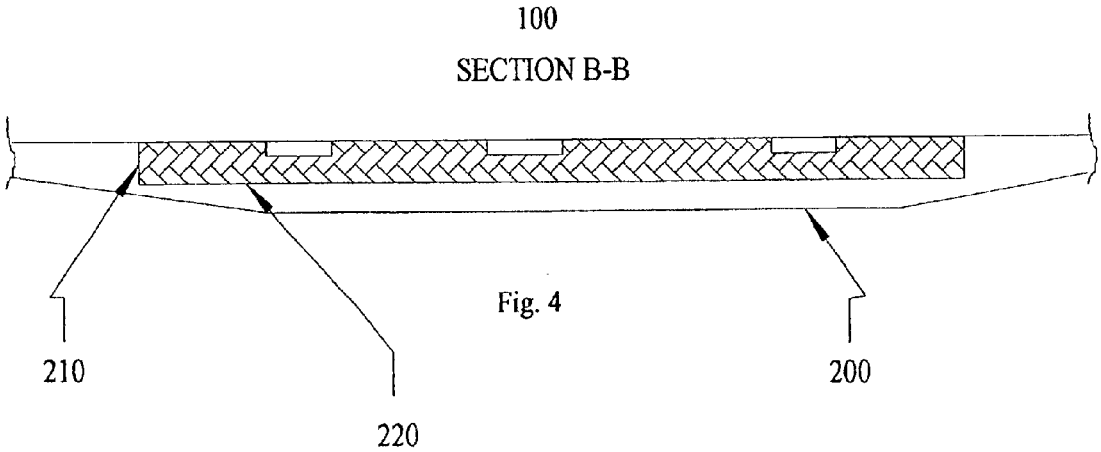
FIG. 4 is a cross-sectional view of the skateboard of FIG. 1 along section line B—B.

For example, with reference now to FIGS. 2–4, board 100 generally comprises a frame 200 which comprises a "skeleton" of the skateboard. As will be described hereinbelow, frame 200 provides various advantages to board 100 including improved physical characteristics and the ability to change those characteristics.

In the presently described embodiment, frame 110 is comprised of aluminum and in its various embodiments, frame 200 may be comprised of molded, cast or otherwise forged aluminum depending on the particular aspects of the application of board 100, preferably in the generally desired shape of board 100. Of course, it should also be appreciated that in various other embodiments of the present invention, materials other than aluminum may be substituted. For example, materials having properties similar to aluminum, namely, substantially rigid and having a desirable strength to weight ratio may be used. For example, materials such as titanium, molybdenum, fiberglass and/or various composite materials may suitably be substituted for the aluminum frame mentioned herein.

In the presently described embodiment, frame 200 further comprises a plurality of windows 210. Windows 210 suitably allow various materials to be integrated with frame 200, thereby providing the ability to change the look, feel and various properties of board 100. For example, in this embodiment, frame 200 includes 8 windows 210. Of course it should be appreciated, that any number of windows may be used, again, depending on the application of board 100. Additionally, windows 210 may have various shapes and configurations. For example, in the present instance, windows 210 are configured with a generally rectilinear shape. However, one skilled in the art will appreciate that windows 210 may be configured with any number of shapes and sizes. Similarly, though in the illustrated embodiment, windows 210 are configured as apertures which pass through the entirety of frame 200, windows may likewise comprise "pockets" which are configured in frame 200. Thus, in any event, it will be appreciated that windows 210 comprise any suitable configuration which allows the insertion of various property changing materials 220 into windows 210, and in various aspects, change various attributes of board 100.

To illustrate, in one exemplary embodiment, while frame 200 comprises aluminum, property changing material 220 comprises a different material, such as Kevlar™, graphite or fiber glass, though as with core 110 described above, it will appreciated that various other materials such as various plastics, nylons, metals and other similar materials, or even the same material, may likewise be substituted depending on the desired properties and still fall within the ambit of the appended claims. Property changing materials 220 are configured in substantially the same shape, size of windows 210 so that they maybe integrated into windows 210. In the presently described embodiment, given that frame 200 and materials 220 each have their own unique physical properties, the combination of the integration of materials 220 with frame 200 change the overall physical characteristics of board 100.

Accordingly, various advantages of board 100 having such configurations are thus realized. For example, the surfaces on board 100, in the context of a skateboard, suitably are improved with respect to sliding ability. Another aspect of the present invention allows the creation of a variable stiffness deck to accommodate users of various weights or field preferences. For example, the stiffness of board 100 may be adjusted to be similar to that of a laminated wood deck, yet having a much stronger resistance to the stresses applied to it. Similarly, board 100 may be adjusted to have a weight that is similar to that of a laminated wood deck and again, have a stronger tolerance for the stresses applied to it.

Additionally, benefits of board 100 include the ability for it to be manufactured with various know and novel manners. For example, board 100 may be manufactured by first cutting the various materials into substantially desired shape. In the event non-prepreg materials are used, they would then be impregnated or coated with glue or another matrix. Next, the materials are stacked and placed in their proper positions in a specific order using various alignment tools as necessary. The stacked materials are suitably placed into a final shape cavity, cutout, mold or other such device. The entire assembly is then cured and the cured materials are then finished (e.g. smooth edges, apply graphic, trucks, binding, etc.)

Finally, it should be appreciated that the present invention has been described above with reference to several exemplary embodiments. However, many changes, combinations and modifications may be made to those and other embodiments without departing from the scope of the present invention. For example, the various components described above may be implemented and combined in alternate ways. These alternatives can be suitably selected depending upon the particular application or in consideration of any number of factors associated with the invention. In addition, the techniques described herein may be extended or modified for use with other types of devices and should not be considered as limited merely to skateboards. Rather, these and other changes or modifications are intended to be included within the scope of the present invention.

We claim:

1. An improved sporting board, comprising:

a core material having substantially the same shape as the sporting board and having an upper surface, a lower surface and an outer perimeter, and a groove proximate to the center of said core material;

a guard having a top surface and a bottom surface, said guard surrounding said outer perimeter and attached to said core via an edge attachment mechanism, said edge attachment mechanism further comprising a tongue configured to attach to said groove;

an upper reinforcement layer applied to said upper surface and a lower reinforcement layer applied to said lower surface, said upper and lower reinforcement layers overlapping said top and bottom surfaces of said guard.

2. A board in accordance with claim 1, wherein said tongue and said groove are bonded with an adhesive.

3. A board in accordance with claim 1, wherein said upper and lower surfaces are adhered to said guard.

4. A board in accordance with claim 1, wherein at least one of said upper protective layer and said lower protective layer include a graphic design.

5. An improved skateboard, comprising:

a core material having substantially the same shape as the skateboard and having an upper surface, a lower surface, an outer perimeter and a groove proximate to the center of said core material, a guard having top and bottom surfaces, said guard surrounding said outer perimeter and attached to said core via an edge attachment mechanism, said edge attachment mechanism and having a tongue configured to attach to said groove, wherein said core defining a plurality of windows within said outer perimeter, said windows having at least one open side, said windows configured to receive a property changing material configured in substantially the same shape as said windows; and an upper reinforcement layer applied to said upper surface and a lower reinforcement layer applied to said lower surface, said upper and lower reinforcement layers overlapping said top and bottom surfaces of said guard.

6. A board in accordance with claim 5, wherein at least one of said upper protective layer and said lower protective layer include a graphic design.

* * * * *